US005360128A

United States Patent [19]

Hessenthaler

[11] Patent Number: 5,360,128

[45] Date of Patent: Nov. 1, 1994

[54] JEWELRY CASE AND COMPONENTS

[76] Inventor: George D. Hessenthaler, 1415 Skyview Dr., Salt Lake City, Utah 84124

[21] Appl. No.: 824,037

[22] Filed: Jan. 23, 1992

[51] Int. Cl.[5] ..... B65D 6/26

[52] U.S. Cl. ..... 217/13; 217/12 R; 220/4.33

[58] Field of Search ..... 403/403, 205, 382; 52/656.1, 475, 476; 220/4.33, 4.22, 334; 217/12 R, 13, 65, 43 R, 45, 56, 57

[56] References Cited

U.S. PATENT DOCUMENTS

| | | | |
|---|---|---|---|
| 376,881 | 1/1888 | Haish . | |
| 984,784 | 2/1911 | Tilton | 217/13 |
| 1,537,678 | 5/1925 | Jensen | 403/403 |
| 2,735,146 | 2/1956 | Purviance | 403/403 |
| 2,956,705 | 10/1960 | Clingman | 217/12 R |
| 3,261,493 | 7/1966 | Smith | 217/65 |
| 3,426,721 | 2/1969 | Agee . | |
| 4,161,077 | 7/1979 | Beslow . | |
| 4,828,132 | 5/1989 | Francis, Jr. et al. | 220/4.33 |

FOREIGN PATENT DOCUMENTS

| | | | |
|---|---|---|---|
| 438441 | 5/1912 | France | 217/65 |
| 130489 | 3/1928 | Switzerland . | |
| 2064699 | 6/1981 | United Kingdom . | |

OTHER PUBLICATIONS

Hoffmann Machine Company, Inc. brochure titled "The Total Solution," all pages, published prior to Jan. 23, 1992.

Hoffmann Machine Company, Inc. brochure titled "Hoffman Woodworking Machines and Accessories for Wood and Plastic Processing," pp. 4, 5 and 11 (back cover), published prior to Jan. 23, 1993.

Pistorius Machine Co., Inc. bulletin titled "Wedgelok TM Joining System," pp. 1 and 4 (front and back covers), 1991.

Pistorius Machine Co., Inc. bulletin titled "Model WL-BA, Bench Model Wedgelok TM Routing Machine," front and back (both pages), 1991 or earlier.

Pistorius Machine Co., Inc. price list for "Wedgelok TM Joining System," front and back (both pages), 1991.

*Primary Examiner*—Stephen Castellano

*Attorney, Agent, or Firm*—Kilpatrick & Cody

[57] ABSTRACT

A wooden jewelry case having sides joined at their ends by miters locked together with brass compression splines having a twibill cross sectional shape. A top and bottom are each attached to the sides with locking splines having a cross sectional shape similar to the figure "8," which locking splines permit the top and bottom to float within the frame provided by the sides and thereby accommodate wood movement. After assembly of the sides, they are typically cut longitudinally to separate the body of the case from a lid assembly that may be hinged to the body with pin type hinges.

6 Claims, 3 Drawing Sheets

JEWELRY CASE AND COMPONENTS

BACKGROUND OF THE INVENTION

This invention relates to wooden cases, particularly small cases constructed of solid wood, such as jewelry cases, but also including larger structures such as cabinets and coffins such structures constructed of composite, laminated and other man-made materials.

An enormous variety of wooden cases, boxes, coffins containers have been built throughout history for numerous purposes ranging from the most mundane storage and transportation tasks to the most sacred human activities, where such structures have been used in religious ceremonies. As a result, uncounted numbers of case configurations and constructions have been utilized in the fabrication of both cases that are built one at a time and production versions having parts manufactured in multiples.

Despite the substantial prior art in this field, continued development remains possible, particularly in light ongoing developments in machining equipment and techniques.

In a typical case having a generally square or rectangular structure and a hinged lid, the fundamental questions are these:

1. How do the sides join each other?
2. What is the structure of the lid?
3. How is the bottom attached?
4. How does the top attach to lid sides, if there are lid sides?
5. How is the lid hinged onto the case?

While numerous answers have been developed to all of these questions, difficulties continue to exist with respect to all of them. For instance, case sides are often constructed of solid wood with the grain of all sides running either parallel to or perpendicular to the bottom. In order to avoid visible end grain, such sides are often mitered at 45° angles and then joined with through fasteners, a variety of types of splines, joints or simply with glue. It is frequently very difficult, however, to construct a case with such mitered side joints with tight joints that are square, particularly without the use of clamps and most particularly without extensive reliance on glue or adhesive. Attachment of case tops and bottoms presents additional problems when the objective is construction of an attractive case that may be assembled quickly and that does not display unsightly end grain when solid wood is employed. Another significant problem is differential wood movement with humidity changes with and across the grain. When a solid wood top or bottom is attached to solid wood sides, two-end-grain-to-long-grain joints result, regardless of whether the grain in the case sides is oriented vertically or horizontally.

SUMMARY OF THE INVENTION

These and other problems associated with construction of wooden cases and similar structures are addressed in the case and case assembly methods of the present invention. A case is typically fabricated from six boards. Two pairs of boards, (1) a front and back and (2) two ends, are mitered on their ends and machined on the face of each miter to receive one-half of a double concave/double convex spline. The top and bottom edges of each case side are machined to include a rabbet, one face of which is also machined to include an omega-shaped groove.

Assembly is accomplished by first driving the double concave/double convex splines into spline-receiving grooves in the case sides in order to form rigidly connected, square case sides that may be assembled, if desired, without the use of glue.

A top and bottom are formed with rabbeted edges, the protruding faces of which are machined with omega-shaped grooves identical to those in the case side edges. Each of the top and bottom are assembled by pressing locking splines having a cross-sectional shape like the figure "8" into either of the sides or top and then pressing the other of the sides or top onto the spline, thus "snapping" the splines into place. The case top is then separated from the case bottom by sawing a parting line through the sides a desired distance from the top edge of the sides.

Blind holes for hinges are bored through the case back from the bottom edge to a point just short of the top edge of the back before the lid assembly is separated from the case bottom assembly. A groove intersecting each hinge-receiving hole may then be machined into the inside face of the back side of the lid assembly to receive a hinge stop at a fixed distance from the lower edge of the case back side of the lid assembly. A stop is inserted in each slot, a pin-type hinge is inserted in each hinge-receiving hole until it contacts the stop, and the other end of the pin-type hinge is inserted in the corresponding hole in the case back. The upper and lower barrels of the pin-type hinges may be fixed in place by drilling holes for and inserting transverse fixing pins through the case and lid assembly back and hinge pins.

The present invention therefore solves the problems associated with case construction described above while providing an economical, very attractive and sound method and assembly for case construction that is particularly well adapted to the economical fabrication of substantial numbers of identical cases and assembly of such cases with relatively little skill. Other advantages of the present invention will become apparent by reference to the attached drawings and the following description of those drawings and claims.

DETAILED DESCRIPTION OF THE DRAWINGS

Figure 1:
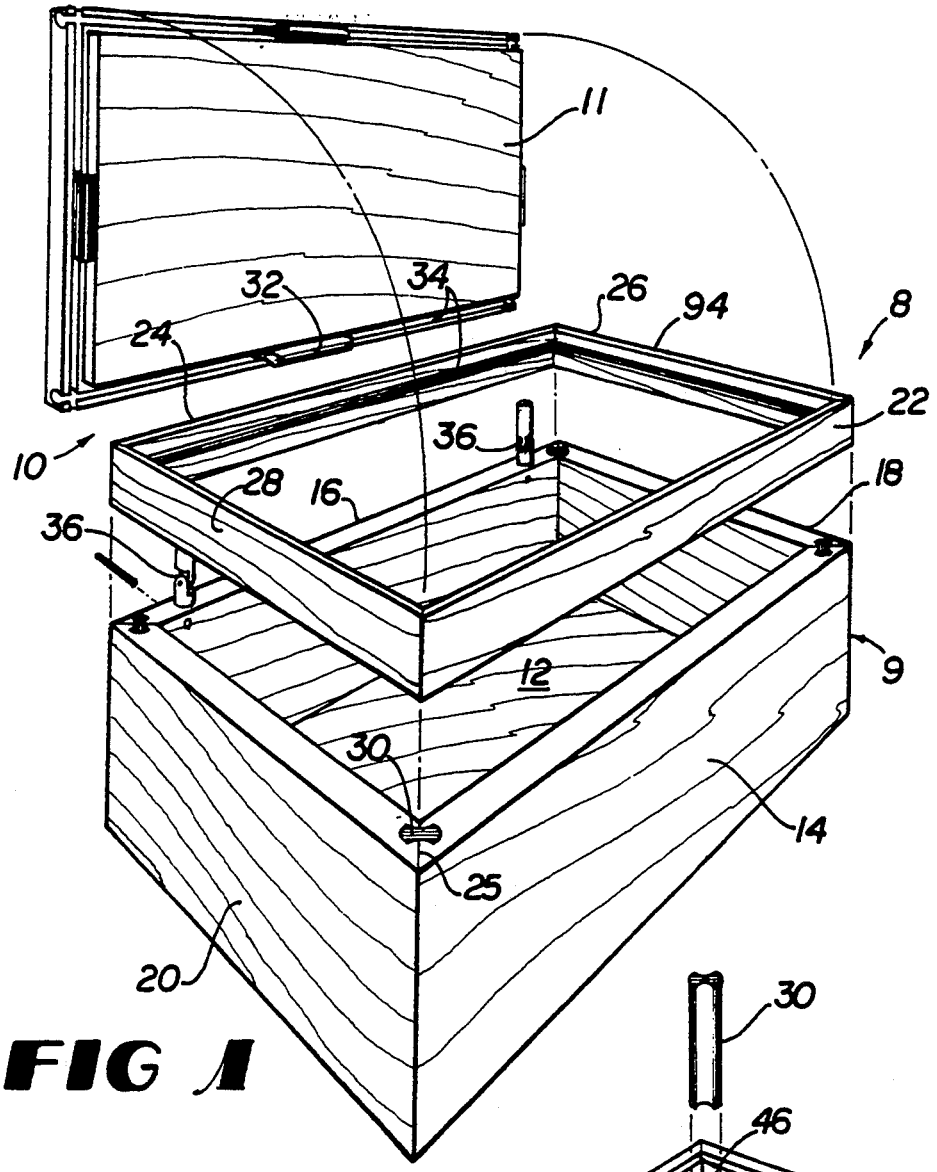
FIG. 1 is a perspective view of the front and left side of a typical case constructed in accordance with the present invention, shown with some of the components exploded apart.

FIG. 1 illustrates generally the structure and components of a case 8 constructed in accordance with the present invention. It includes a bottom assembly 9 and lid assembly 10. The bottom assembly 9 includes a bottom 12 and four case sides, including a front 14, back 16, right end 18 and left end 20. Lid assembly 10 includes a top 11 framed by a lid front 22, lid back 24, lid right end 26 and lid left end 28. The case sides 14, 16, 18 and 20 and the lid assemble 10 sides 22, 24, 26 and 28 are joined by miter joints such as joint 25. Each miter joint is reinforced by a compression spline having a cross sectional shape like a twibill (an archaic term for a two-bladed battle ax) that also resembles the side profile of the head of a double bit woodsman's ax. This twibill shape, easily visible in spline 30 illustrated in FIG. 4, has a pair of opposed convex surfaces 50 and a pair of opposed concave surfaces 42, each of which surfaces may typically be an arc of a circle.

Each of top 11 and bottom 12 are framed by their corresponding front, back and end members and are joined to those members by lengths of locking spline 32 that seat in a generally round, or omega-shaped groove 34 in the members joined. Pin-type hinges 36 received in the case back 16 and lid back 24 form a hinge connection between the lid assembly 10 and bottom assembly 9.

Although other construction sequences are feasible, construction of the case 8 by forming a unitary box having four sides and a top and bottom and then parting the lid assembly by sawing through the case 8 sides (to form a lid assembly 10 having a top 11 and lid front 22, lid back 24, lid right end 26 and lid left end 28) will insure that the grain on case 8 sides matches and that lid assembly 10 perfectly fits bottom assembly 9. It also facilitates accurate placement of the hinges 36, as will be further described below.

Miter Joint Compression Spline

Figure 4:
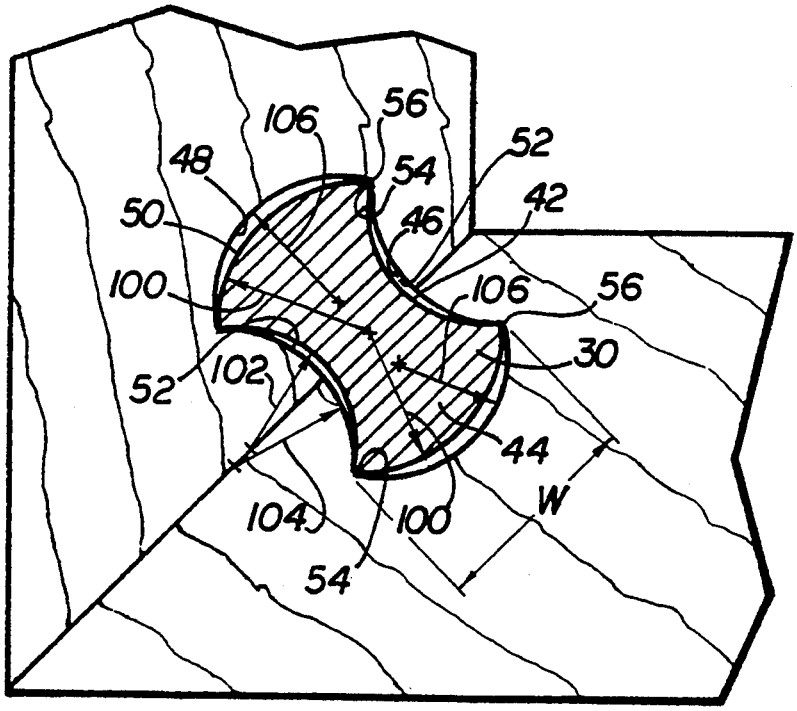
FIG. 4 is an enlarged view of the case corner shown within circle 4 in FIG. 3.

The miter joint compression spline 30 of the present invention, well illustrated end-on in FIG. 4, may be fabricated of a variety of materials having suitable properties utilizing a variety of fabrication techniques, including various molding and machining techniques. A particularly desirable material is brass, and the twibill shape of compression spline 30 may be formed by machining arcuate longitudinal concavities 42 in a round bar or rod 44 of brass.

As may be seen by reference to FIG. 4, an opposed pair of compression spline grooves 46 generally mirror the geometry of compression spline 30 but importantly differ from that geometry in that the bottom 48 of each groove 46 has a cross-sectional arc with a radius 106 slightly shorter than the radius 100 of the corresponding convex arcuate portion 50 of spline 30. Alternatively, the bottom shape 48 can be a section of an ellipse, rather than of a circle, so that in either event the shape of bottom 48 is a "tighter" curve than the adjacent portion of spline 30. Similarly, the opposed sides 52 of each groove 46 together form an arc (or a section of an ellipse) having a radius 104 slightly greater than the radius 102 of the concave arcuate portion 42 of spline 30. As a result, compression spline 30 contacts the wood members it joins only at the corners 54 of the compression spline grooves 46.

While a variety of different dimensions and arcuate, elliptical or other geometries for compression splines 30 and compression spline groove 46 may be utilized, workable dimensions are as follows. A compression spline 30 may be machined, for instance, form a rod 5/16" (0.3125") in diameter. The radius of the convex surfaces 50 of such a compression spline 30 would be 5/32" (0.15625"), and the radius 102 of concave face 42 of compression spline 30 may be 0.188". A suitable groove 46 for receiving such a compression spline 30 may have a groove wall 52 with a radius 104 that provides a 0.010" gap between and the spline 30 concave face 42 at midpoint, and a groove bottom 48 with a radius 106 that also provides a gap on the order of 0.010" between the bottom 48 and spline 30 convex surface 50 at midpoint.

As is apparent in FIG. 4, and of critical importance, the edges 56 of compression spline 30 dig into corners 54 of opposing grooves 46 and thereby hold the joint together. Because there is, as described above, very limited contact (and thus little friction) between the surfaces of compression spline 30 and the walls of spline grooves 46, spline 30 may be easily driven into the grooves 46 during assembly.

Locking Spline

Figure 5:
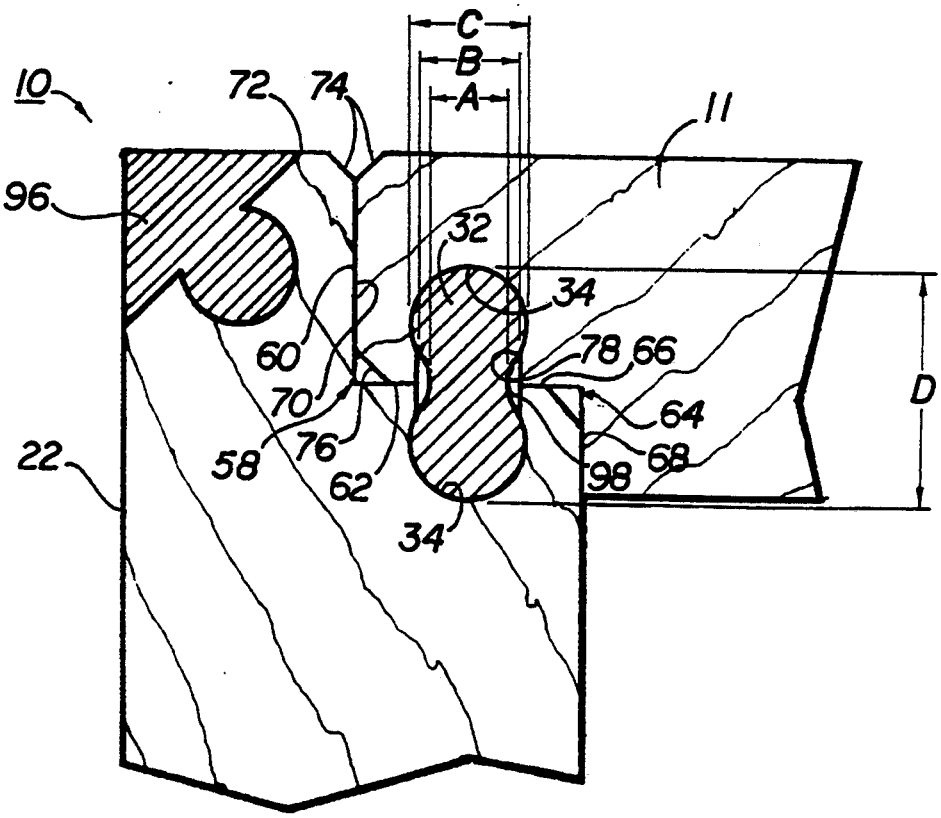
FIG. 5 is a cross sectional view taken along lines 5—5 in FIG. 3 showing the case lid structure and locking spline.

FIG. 5 illustrates a cross-section taken through the top assembly 10 in order to show the way lid 11 is joined to a lid side such as lid front 22 by locking spline 32.

A rabbet 58 having a protruding face 60 and inner face 62 is machined in lid front 22. A rabbet 64 having a protruding face 66 and inner face 68 is likewise machined in top 11. The depth and geometry of rabbet 64 is chosen so that protruding face 66 of rabbet 64 will be equal in width to inner face 62 of rabbet 68 in lid front 22. The depth of inner face 68 of rabbet 64 is chosen so that the width of edge 70 will be equal to the width of protruding face 60 of rabbet 58. This will result in a flush fit between lid 11 and the upper edges of the lid front 22, lid back 24, lid right-end 26 and lid left-end 28. If desired, other relative measurements between edge 70 and protruding face 60 may be chosen so that the lid sits proud of or is recessed below the edge 72 of lid front 22. If desired, a decorative chamfer or "reveal" 74 may be machined in the edges 72 and 70. A similar chamfer 76 on the portion of edge 70 lying in the rabbet 58 may facilitate the fit between top 11 and lid front 22.

Each of protruding face 66 of lid 11 and inner face 62 of lid front 22 are machined with generally round grooves 34 that open to the respective inner face 62 or protruding face 66 so that they have a generally omega-shaped or slot-intersecting-a-circle cross-section, with a throat 78 slightly smaller than the largest diameter of the groove 34.

Locking spline 32 has a cross-sectional shape generally like the outline of a figure "8" that closely corresponds to the void left by a pair of opposed grooves 34. Compression spline 32 is inserted first in one of the grooves 34 by forcing one-half of the spline 32 into the face of the groove 34. The corresponding member to be joined and having a similar groove 34 is then forced or "snapped" onto the other half of the spline. This assembly procedure in which the spline 32 enters the face of the groove 34 rather than the end of the groove is possible because the throat 78 of the groove 34 in the wooden member, such as top 11, can expand slightly in order to permit the widest portion ("C" in FIG. 5) of locking spline 34 to pass the throat 78 because of the inherent elasticity of the wood or other material of the member, such as top 11, being joined by the locking spline 32.

If the waist 98 of locking spline 32 is slightly narrower than the throat 78 of each groove 34, each upper or lower portion of locking spline 32 will be able to rotate slightly within the groove 34 within which it is received. Such rotation permits slight misalignment between groove 34 in members being joined by locking spline 32, such as the matching grooves 34 in lid front 22 and the corresponding groove 34 in top 11.

This ability to accommodate misalignment obviates the necessity for a precision fit between top 11 and the members 22, 24, 26 and 28 that frame it. More important, when top 11 is constructed of solid wood, this ability of locking spline 32 to swivel accommodates the inherent dimensional instability of top 11 with changes in humidity by accommodating a small amount of expansion and contraction (typically across the grain) of top 11. Such contraction of top 11 may result in formation of a gap between edge 70 and protruding face 60 illustrated in FIG. 5. Such a small gap is more aesthetically acceptable, however, if chamfers 74 are present so that a shadow line always surrounds top 11.

Typical dimensions (within tolerances of ±0.002") for locking spline 32 shown on FIG. 4 may be a waist 98 having a width "A" of 0.105 and a bulb diameter "C" of 0.125 and a height "D" of 0.250. The width "B" of throat 78 of grooves 34 may be, for instance 0.115.

Hinges

Figure 6:
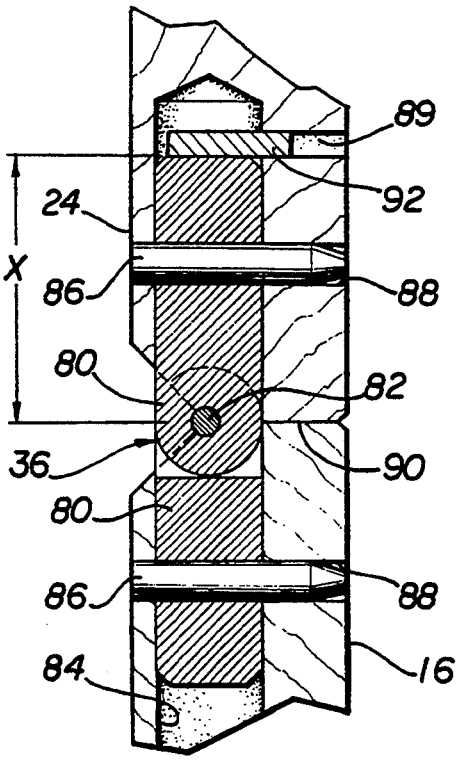
FIG. 6 is a cross section view taken horizontally through a portion of the case and the case hinge structure along lines 6—6 in FIG. 3.

Pin type hinges 36 as illustrated in FIG. 1 and (in cross-section) in FIG. 6 may be used to mount lid assembly 10 on bottom assembly 9. Hinges 36 comprise two barrels 80 that are formed of cylindrical sections of rod and pivot on a hinge pin 82. Barrels 80 are captured in the bore 84 by barrel locking pins 86 located in locking pin holes 88 that are drilled through the face of the lid back 24 or case back 16 and through the respective barrel 80 positioned in the portion of the bore 84 lying within the lid back 24 or case back 16.

Figure 2:
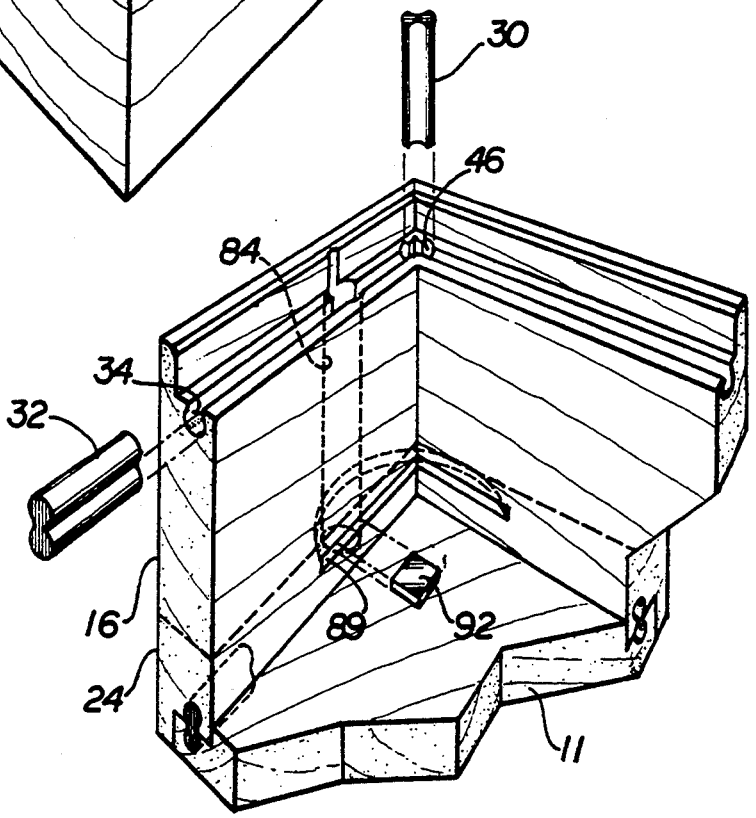
FIG. 2 is a perspective view of an inside top corner of the case illustrated in FIG. 1 shown upside down and before the top assembly is separated from the case structure.
Figure 3:
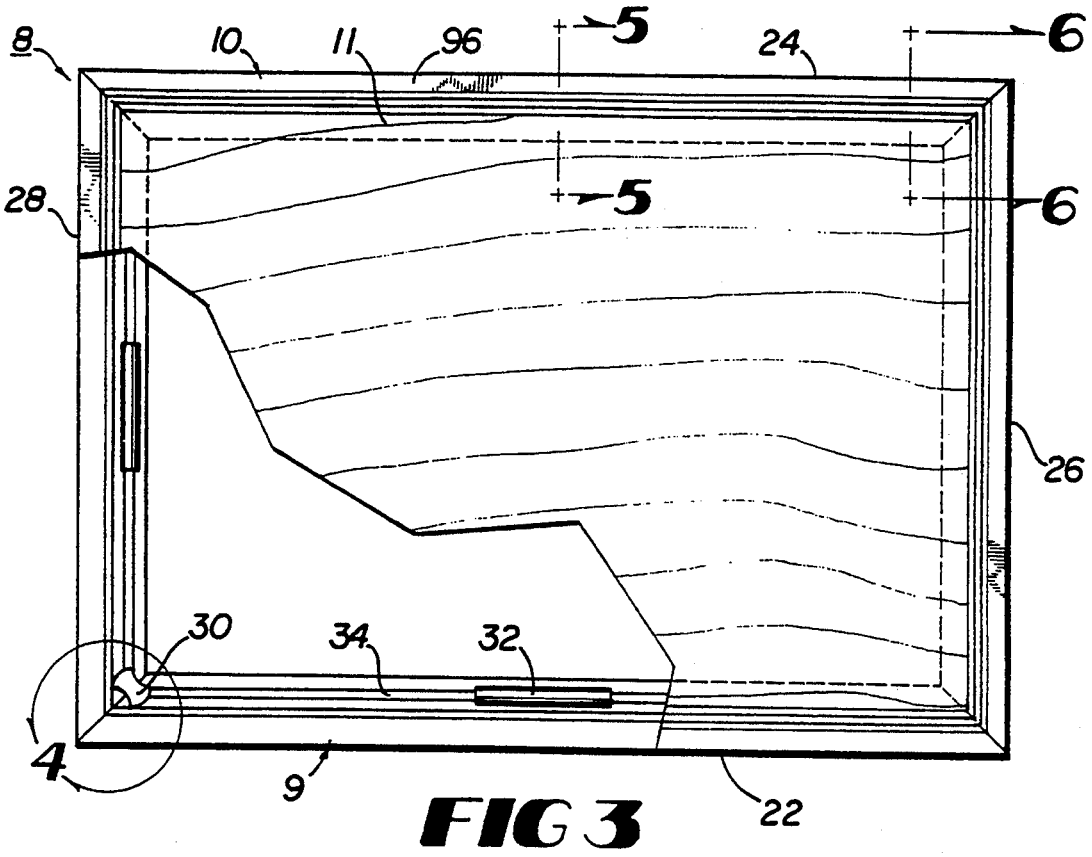
FIG. 3 is a top plan view of the case illustrated in FIG. 1, with a portion of the case top shown broken away.

Bore 84 can advantageously be formed by drilling through the bottom edge of the case back 16 as illustrated in FIG. 2 before the lid assembly 10 is parted from the bottom assembly 9.

After the lid assembly 10 is parted from the bottom assembly 9, a groove 89 may be machined a distance X (illustrated in FIG. 6) from the lower edge 90 of lid back 24 equal to the distance from the center of hinge pin 82 to the end of barrel 80. This slot can be formed, for instance, utilizing a slot cutter mounted on an electric rotor. A stop 92 that may, for instance, be an appropriately dimensioned rectangular section of brass plate material, is positioned in slot 89 to intersect bore 84 and thereby properly stop and position barrel 80 of hinge 36 when barrel 80 is inserted in the portion of bore 84 within lid back 24.

Decorative Edge

Decorative treatment of the peripheral edge 94 of lid assembly 10 may be accomplished by machining the edge 94 to receive a decorative brass strip 96, illustrated in cross-section in FIG. 5. Sections of decorative strip 96 will typically be installed in the members receiving them before they are cut to length so that the ends of the decorative strip are cut precisely flush with the members receiving the decorative strip. The same cutting tool may be used to create groove 105 (FIG. 5) that is employed in making groove 34 (FIG. 5) thus allowing for greater economy and efficiency of expensive custom cutting tools.

As will also be appreciated by one of ordinary skill in the art, the embodiments of the present invention described above in detail are intended to be merely illustrative of the various combinations of components and arrangements of components that can be utilized to obtain the described objectives of the invention without departing from the intended scope or spirit of the foregoing description, the associated drawings and the following claims.

I claim:

1. A miter joint spline comprising a rod made of a material and having, transverse to its length, a cross sectional shape having:

(a) two opposed convex sides that have a first radius of curvature and are separated by the rod material, and (b) two opposed concave sides that have a second radius of curvature different from and substantially congruent to the first radius of curvature and are separated by the rod material, and (c) wherein adjacent rod sides intersect to form a longitudinal edge.

2. The spline according to claim 1, wherein the rod is brass.

3. The miter joint spline of claim 1 wherein the radius of curvature of the convex sides is approximately seven thirty-seconds of an inch and the radius of curvature of the concave sides is approximately one hundred eighty-eight thousands of an inch.

4. A woodworking joint comprising:

(a) a first member having a face surface and a second member having a face surface contacting the first member face surface, (b) a groove in the first member face surface having a concave first groove bottom and a pair of first groove walls that flare from the first member face surface to form intersections with the first groove bottom, (c) a groove in the second member substantially identical to the groove in the first member, positioned in alignment with the first member groove and having a concave second groove bottom and a pair of second groove walls that flare from the second member face surface to form intersections with the second groove bottom, and (d) a spline positioned within the grooves and contacting the members at the intersections of the groove walls and bottoms to join the first and second members with their face surfaces in contact and the grooves in alignment, the spline comprising a rod made of a material and having, transverse to its length, a cross sectional shape having:

(1) two opposed convex first sides that have a first radius of curvature and are separated by the rod material, and (2) two opposed concave second sides that have a second radius of curvature different from and substantially congruent to the first radius of curvature and are separated by the rod material, and (3) wherein adjacent rod sides intersect to form a longitudinal edge.

5. A case comprising:

(a) at least three case sides, each of which has two ends, wherein the case sides are joined at their ends with joints, each of which joints is locked together with a first compression spline comprising a first rod made of a material and having, transverse to its length, a cross sectional shape having:

(1) two opposed convex first sides that have a first radius of curvature and are separated by the first rod material, and (2) two opposed concave second sides that have a second radius of curvature different from and substantially congruent to the first radius of curvature and are separated by the first rod material, and (3) wherein adjacent rod first and second sides intersect to form a longitudinal edge, (b) a bottom joined to the case sides, and (c) a lid comprising:

(i) a number of lid sides equal to the number of case sides, each of which lid sides has two ends and has a length equal to the length of one of the case sides, wherein the lid sides are joined at their ends with joints, each of which joints is locked together with a second compression spline comprising a second rod made of a second material and having, transverse to its length, a cross sectional shape having:

(1) two opposed convex third sides that have a convex third radius of curvature and are separated by the second rod material, and (2) two opposed concave fourth sides that have a fourth radius of curvature different from and substantially congruent to the third radius of curvature and are separated by the second rod material, and (3) wherein adjacent second rod sides intersect to form a longitudinal edge, and (ii) a top joined to the lid sides.

6. The case of claim 5, further comprising at least two hinges connecting one of the lid sides to one of the case sides.

* * * * *